US009692199B2

(12) United States Patent
Liu

(10) Patent No.: US 9,692,199 B2
(45) Date of Patent: Jun. 27, 2017

(54) TUBE HYDROFORMING OF JOINTLESS USB STAINLESS STEEL SHELL

(71) Applicant: Apple Inc., Cupertino, CA (US)

(72) Inventor: Junhua Liu, Hayward, CA (US)

(73) Assignee: Apple Inc., Cupertino, CA (US)

( * ) Notice: Subject to any disclaimer, the term of this patent is extended or adjusted under 35 U.S.C. 154(b) by 205 days.

(21) Appl. No.: 14/500,957

(22) Filed: Sep. 29, 2014

(65) Prior Publication Data

US 2016/0094001 A1 Mar. 31, 2016

Related U.S. Application Data

(63) Continuation of application No. PCT/US2014/058125, filed on Sep. 29, 2014.

(51) Int. Cl.
*H01R 43/16* (2006.01)
*H01R 43/18* (2006.01)
(Continued)

(52) U.S. Cl.
CPC ..... *H01R 43/18* (2013.01); *B21C 37/06* (2013.01); *B21C 37/08* (2013.01);
(Continued)

(58) Field of Classification Search
CPC .... H01R 13/6581; H01R 24/62; H01R 43/18; H01R 43/16; B21C 37/06; B21C 37/0803;
(Continued)

(56) References Cited

U.S. PATENT DOCUMENTS 3,732,790 A * 5/1973 Miyake ..... B31B 45/00 156/195
3,775,842 A * 12/1973 Sheldon ..... H01F 7/06 264/266
(Continued)

FOREIGN PATENT DOCUMENTS

CN 102554560 7/2012
CN 102646890 8/2012
DE 102015200853 A1 * 7/2016 ..... B21C 37/151

OTHER PUBLICATIONS

US 8,266,939, 09/2012, Mizumura et al. (withdrawn)
PCT Application No. PCT/US2014/058125—International Search Report and Written Opinion dated Jun. 29, 2015.

*Primary Examiner* — Paul D Kim
(74) *Attorney, Agent, or Firm* — Kilpatrick Townsend and Stockton, LLP

(57) ABSTRACT

Methods for forming seamless and jointless metal parts suitable in a manufacturing environment are disclosed. The metal parts can be used in the manufacture of electronic devices and accessories of electronic devices, such as connectors. In particular embodiments, the methods involve forming a seamless cylindrical tube. The seamless cylindrical tube can then undergo a series of shaping processes that retain and exterior seamless surface of the tube. In some embodiments, the shaping processes include a hydroforming process. The methods can be performed without the use of dovetails and other types of visible joints that can complicate the manufacturing process and result in a part with aesthetically unappealing visible joints and seams.

20 Claims, 11 Drawing Sheets

(51) Int. Cl.

| | |
|---|---|
| ***B21D 26/033*** | (2011.01) |
| ***B21C 37/06*** | (2006.01) |
| ***B21C 37/08*** | (2006.01) |
| ***B21C 37/15*** | (2006.01) |
| *H01R 13/6581* | (2011.01) |
| *H01R 24/62* | (2011.01) |

(52) U.S. Cl.
CPC ..... *B21C 37/0803* (2013.01); *B21C 37/0815* (2013.01); *B21C 37/155* (2013.01); *B21D 26/033* (2013.01); *H01R 13/6581* (2013.01); *H01R 24/62* (2013.01)

(58) Field of Classification Search
CPC ... B21C 37/0815; B21C 37/155; B21C 37/08; B21D 26/033
USPC ..... 29/592.1, 830, 832, 841, 848, 854, 856, 29/858, 876, 883
See application file for complete search history.

(56) References Cited

U.S. PATENT DOCUMENTS 5,718,048 A * 2/1998 Horton ..... B21D 5/08 280/785
6,237,382 B1 5/2001 Kojima et al.
6,415,638 B1 7/2002 Sakurai et al.
6,470,790 B1 * 10/2002 Hewitt ..... B23P 15/00 29/888.09
6,530,252 B1 3/2003 Hashimoto et al.
6,999,322 B1 * 2/2006 Lin ..... H05K 5/0278 361/733
7,096,700 B2 8/2006 Marando
7,546,754 B2 6/2009 Yang
7,744,231 B2 * 6/2010 Hutchinson ..... G02B 6/0001 362/555
8,099,989 B2 * 1/2012 Bradley ..... B21D 26/14 29/419.2
8,297,096 B2 * 10/2012 Mizumura ..... B21D 22/025 29/421.1
2003/0172512 A1 * 9/2003 Suarez ..... B21D 26/029 29/421.1
2006/0108123 A1 * 5/2006 De Lucia ..... E21B 28/00 166/380
2008/0045056 A1 * 2/2008 Collantes ..... H01R 13/6485 439/131
2012/0047979 A1 3/2012 Hertell et al.
2012/0069517 A1 3/2012 Prest et al.
2012/0093498 A1 4/2012 Hietala et al.
2013/0214659 A1 8/2013 Prest et al.

* cited by examiner

TUBE HYDROFORMING OF JOINTLESS USB STAINLESS STEEL SHELL

CROSS-REFERENCE TO RELATED APPLICATION

This is a continuation of International Application PCT/US14/58125, with an international filing date of Sep. 29, 2014, entitled "Tube Hydroforming Of Jointless USB Stainless Steel Shell", which is incorporated herein by reference in its entirety.

FIELD

This disclosure relates generally to systems and methods for manufacturing seamless or jointless metal parts, such as metal shells or housings for connectors of electronic devices. In particular, systems and methods that involve hydroforming techniques are described.

BACKGROUND

Universal Serial Bus (USB) connectors, cables and ports are used to quickly and easily connect computers to peripheral devices, such as mice, printers and monitors, as well as other computers. USB connectors generally include male connectors that are configured to mate with female connectors, with the male connectors generally having outer metal shells that surround and protect wires for making electrical connections. Conventional manufacturing techniques for forming these metal shells depend on stamping techniques, which create one or more joints or seams within the metal shells. Unfortunately, using conventional manufacturing methods are prone to mismatching at the joints that can leave gaps and cause galling, scratching, and other surface defects on the metal shells. These mismatched joints and surface defects can negatively affect the surface quality of the metal shells as well as detract from the aesthetics of the metal shells and the USB connectors.

SUMMARY

This paper describes various embodiments that relate to manufacturing of seamless or jointless metal parts that use hydroforming techniques. In particular embodiments, the manufacturing methods are used to form portions of connectors and ports, such as USB connectors and ports.

According to one embodiment, a method of forming a connector for an electronic device is described. The method involves forming a flat tube by flattening a cylindrical tube. The flat tube has a first end portion, second end portion and an internal hollow portion. The method also involves arranging the flat tube in a die. The method additionally involves forming a metal shell by injecting pressurized fluid within the internal hollow portion until the first end portion expands to conform with a geometry of the die. The metal shell corresponds to a portion of a housing of the connector. The first end portion is configured to accept a molded portion of the housing.

According to another embodiment, a method of forming a connector for an electronic device is described. The method involves forming a flat tube by flattening a cylindrical tube. The method also involves cutting a flat tube section from the flat tube, the flat tube section including opposing end portions. The method further involves arranging the flat tube section in a die. The method additionally involves injecting pressurized fluid within the flat tube section until each of the opposing end portions expands to conform with a geometry of the die. The method also involves cutting a metal shell from the flat tube section such that the metal shell includes an expanded end portion. The metal shell corresponds to a portion of a housing of the connector.

According to a further embodiment, a non-transitory computer readable medium for storing a computer program executable by a processor for forming a connector for an electronic device is described. The non-transitory computer readable medium includes computer code for forming a flat tube by flattening a cylindrical tube. The flat tube has a first end portion and second end portion. The non-transitory computer readable medium also includes computer code for arranging the flat tube in a die. The non-transitory computer readable medium additionally includes computer code for forming a metal shell by injecting pressurized fluid within the flat tube until the first end portion expands to conform with a geometry of the die. The metal shell corresponding to a portion of a housing of the connector. The first end portion is configured to accept a molded portion of the housing.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

Described herein are methods for forming seamless and jointless metal parts. The methods are well suited for use in the manufacture of a product line of multiple similar or identical parts. In particular embodiments, the metal parts correspond to housing portions of connectors for computer electronics, such as USB, mini USB and micro USB connectors. In some embodiments, the methods involve forming a flat tube from a seamless cylindrical tube. Portions of the flat tube are expanded using, for example, a hydroforming process such that exterior surfaces of the flat tube remain seamless. The flat tube can then be further processed to from a seamless and aesthetically appealing metal shell. The metal shell can be further manufactured to form a housing for a connector.

In some embodiments, the seamless cylindrical tube is formed by coiling, rolling, bending, stamping and/or pressing a flat metal sheet into a cylindrical form. The ends of the metal sheet are then seamlessly joined together using, for example, a laser welding process. The seamless cylindrical tube can then be flattened using, for example, a die assembly that has opposing flat die surfaces that are pressed against the cylindrical tube. The resulting flat tube can be cut into flat tube sections and/or cut to remove sacrificial portions. The flat tube sections can then be positioned within a hydroforming die. Pressurized fluid is then passed through the flat tube section to expand portions of the flat tube section. In a particular embodiment, end portions of the flat tube section are expanded or flared. The expanded flat tube section can then be cut to form the metal shell. In some embodiments, the metal shell is further processed for cosmetic purposes or for facilitating a subsequent molding process.

Methods described herein are well suited for manufacture of durable, reliable and aesthetically appealing portion of consumer electronic products, such as portions of computers, portable electronic devices and electronic device accessories manufactured by Apple Inc., based in Cupertino, Calif.

These and other embodiments are discussed below with reference to FIGS. 1-9. However, those skilled in the art will readily appreciate that the detailed description given herein with respect to these Figures is for explanatory purposes only and should not be construed as limiting.

Figure 1A:
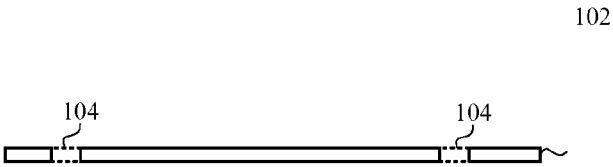
FIGS. 1A-1E show different manufacturing stages of forming metal shell for a USB connector using conventional techniques.
Figure 1B:
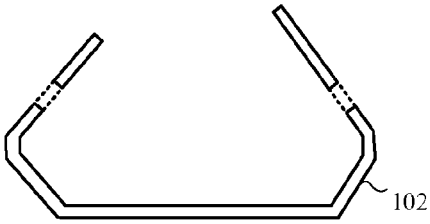
Figure 1C:
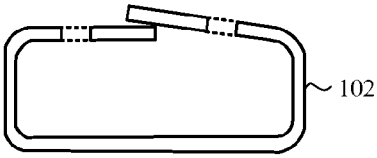
Figure 1D:
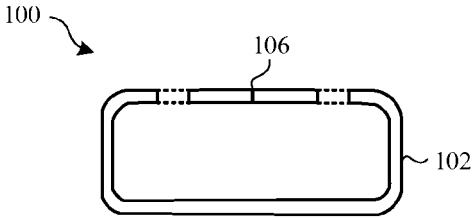
Figure 1E:
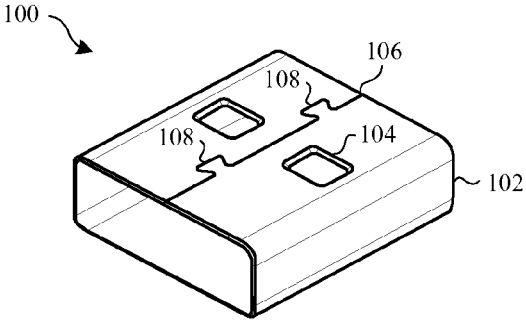
FIG. 1E PRIOR ART

The methods described herein can be used to form seamless metal parts, such as metal shells of USB and other types of connectors. The methods described herein differ from conventional manufacturing techniques in a number of ways. To illustrate, FIGS. 1A-1E show different manufacturing stages of forming metal shell 100 for a USB connector using conventional techniques. At FIG. 1A metal sheet 102 is provided. A typically metal sheet 102 is made of stainless steel and can include features such as openings 104. At FIGS. 1B-1C, metal sheet 102 is progressively bent to have a rectangular shape using conventional bending and/or stamping methods until the ends of metal sheet 102 meet at joint 106. FIGS. 1D and 1E shows section and perspective views of metal shell 100 after the bending and stamping processes are complete. Often the ends of metal sheet 102 will include dovetail features 108 that interlock with each other at joint 106 in the final form of metal shell 100. Dovetail features 108 keep the ends of metal shell 100 together. Metal shell 100 can act as portion of a housing for a USB connector.

Dovetail features 108 have specific shapes that must correspond with each other in order to properly fit together, similar to a jigsaw puzzle. This means the tolerances in the manufacturing process must be very small in order for the shapes of dovetail features 108 to fit snuggly. If the shapes of dovetail features 108 do not properly match, this can leave gaps between dovetail features 108 and joint 106. In addition, the bending and shaping process shown in FIGS. 1A-1E must be very accurate in order to properly align dovetail features 108 with each other. If dovetail features 108 do not properly align during the bending process, a number of modifications during the bending process may be required, which can cause galling or scratching of the exterior portions of metal shell 100. These factors complicate the manufacture of metal shell 100. In addition, joint 106 with dovetail features 108 are located on exterior portions of the USB connector and are therefore readily visible to a user, which can be aesthetically unappealing.

Figure 7:
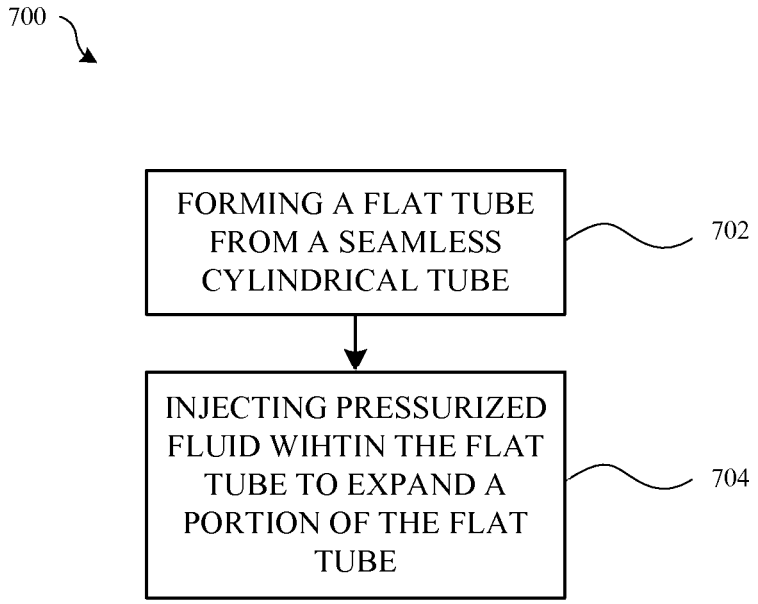
FIG. 7 shows a flowchart indicating a high-level process for forming a metal shell as part of a housing for a connector in accordance with described embodiments.
Figure 8:
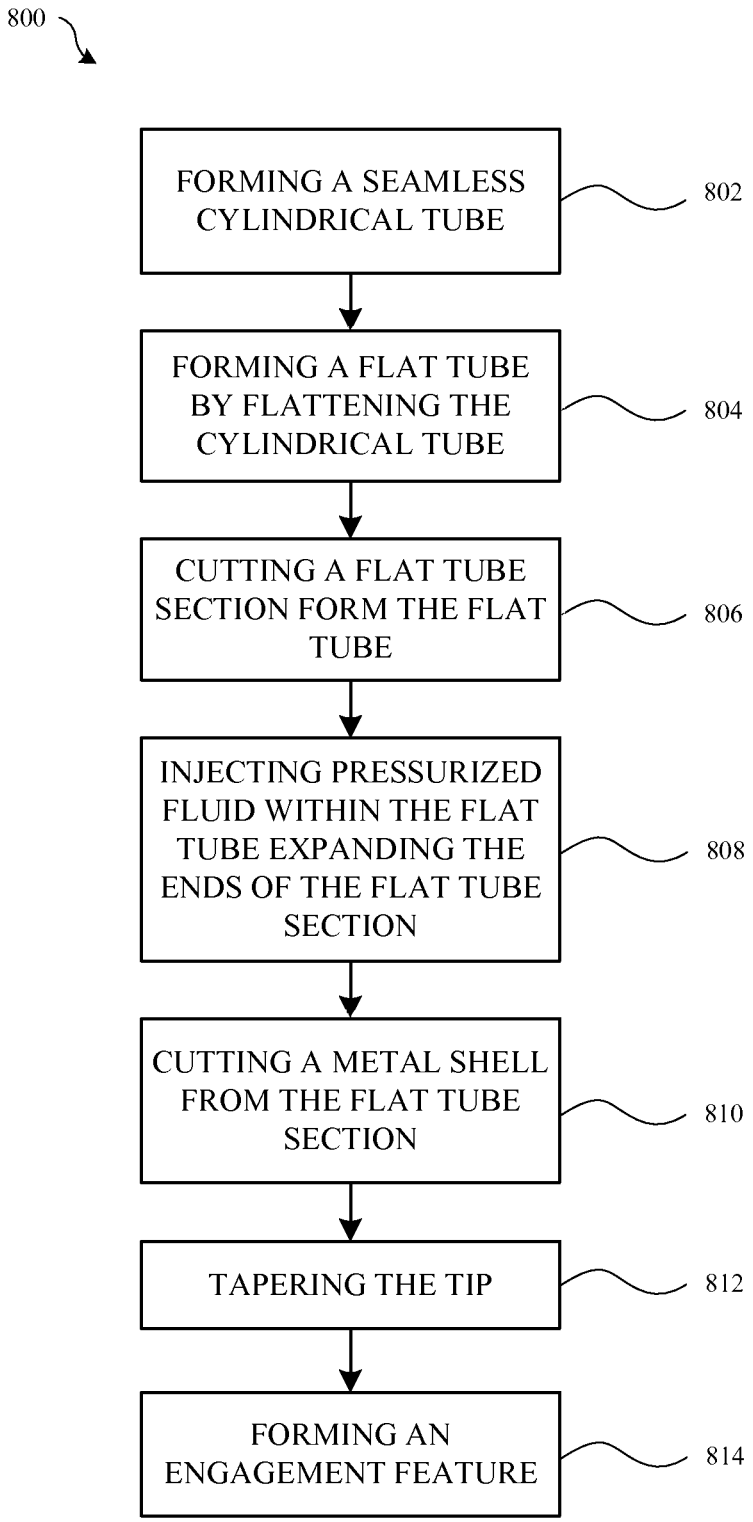
FIG. 8 shows a flowchart indicating a manufacturing process for forming a metal shell as part of a housing for a connector in accordance with described embodiments.
Figure 9:
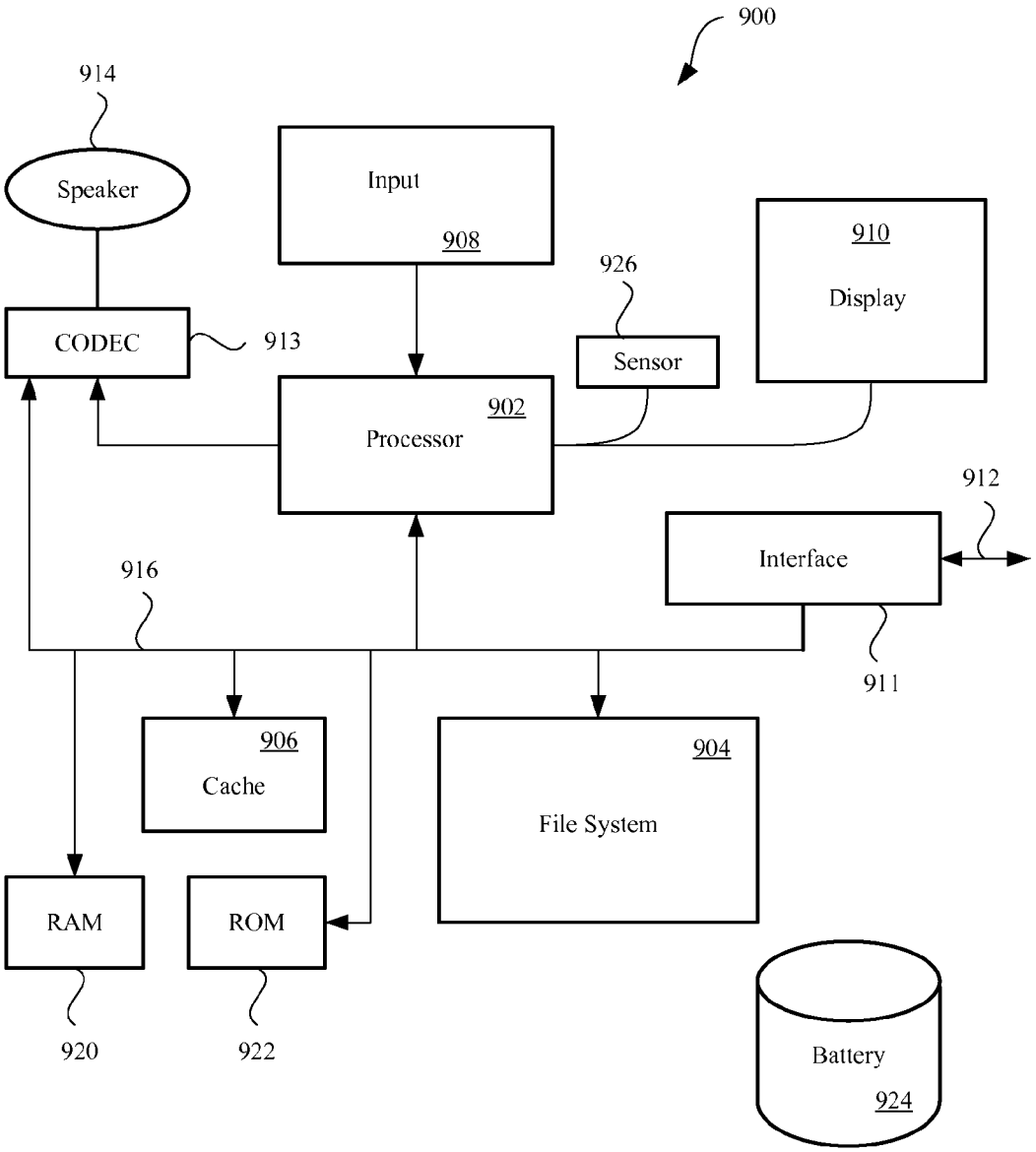
FIG. 9 is a block diagram of an electronic device as part of a CNC machining system for performing one or more manufacturing processes in accordance with the described embodiments.

To address these issues, methods described herein can be used to provide hollow jointless or seamless metal shells. The methods can be used in a manufacturing setting where a number of repeatable processes are performed to produce a product line of similar or identical parts. FIGS. 2-6 show a manufacturing process for forming hollow jointless metal parts, in accordance with some embodiments. FIGS. 7 and 8 show flowcharts summarizing a high level process for forming a metal part and a particular manufacturing process, in accordance with some embodiments. FIG. 9 shows a schematic of a device that can be used in connection with a CNC manufacturing process for manufacturing the metal parts.

Figure 2A:
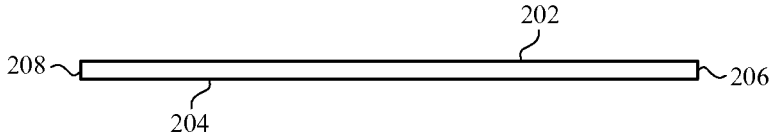
FIGS. 2A-2C show section views of a seamless cylindrical tube being formed using a process in accordance with described embodiments.
Figure 2B:
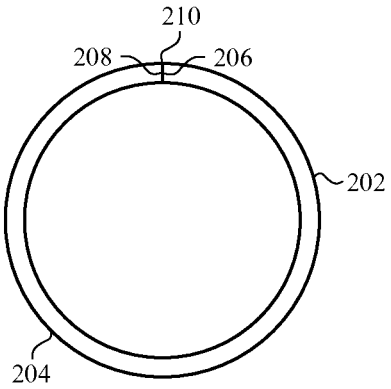
Figure 2C:
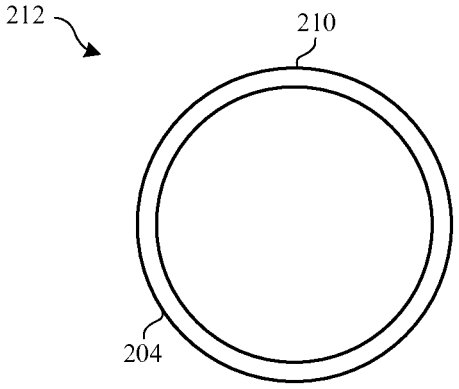

FIGS. 2A-2C show section views of a seamless cylinder tube 212 being formed using a process in accordance with some embodiments. At FIG. 2A, a flat sheet of metal, also referred to as a blank 202, is provided. Blank 202 includes first end 206 and second end 208. Blank 202 can be made of any suitable material. In some embodiments, blank 202 is made of a metal material, such as stainless steel material or an aluminum alloy. The thickness of blank 202 can vary depending on the types of subsequent shaping processes and on a desired final thickness. In some embodiments, blank 202 has a smooth exterior surface 204.

At FIG. 2B, blank 202 is shaped such that first end 206 is proximate or contacts second end 208 at a joint 210. At this point blank 202 has a cylindrical tube shape where exterior surface 204 corresponds to an exterior surface of the cylindrical tube. Any suitable shaping technique or combination of shaping techniques can be used. For example, any of a number of coiling, rolling, bending, stamping and/or pressing techniques can be used. In some embodiments, a series of stamping operations where blank 202 is placed within a series of different dies that gradually change the shape of blank to a desired shape is used. In a particular embodiment, a series of 15 or more stamping procedures using 15 or more dies is used.

At FIG. 2C, first end 206 is joined with second end 208 at joint 210 forming cylindrical tube 212. In some embodiments, a laser welding process is used to weld joint 210 such that joint 210 is substantially undetectable by a person without the use of visual aids. In some embodiments, exterior surface 204 remains smooth and free off seams and/or joints. In this way, cylindrical tube 212 is seamless and jointless. The length of cylindrical tube 212 can vary depending on application requirements and manufacturing tools and capabilities. In some embodiments, cylindrical tube 212 is cut into smaller sections prior to subsequent processing.

Figure 3A:
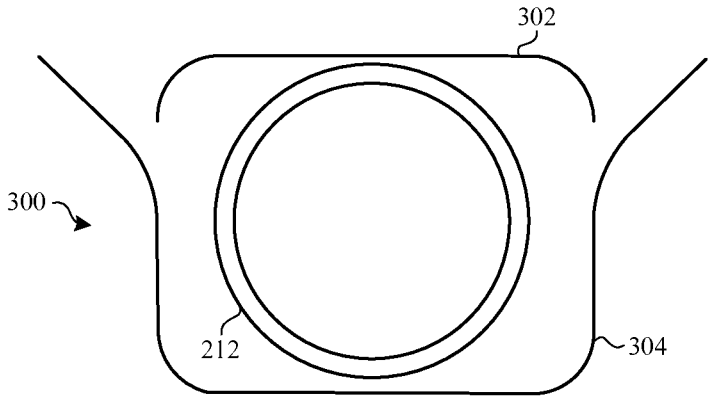
FIGS. 3A-3C show section views of a flat tube being formed from the seamless cylindrical tube described with reference to FIGS. 2A-2C.
Figure 3B:
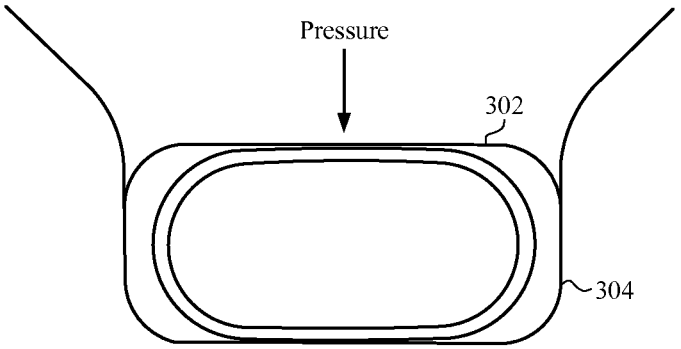
Figure 3C:
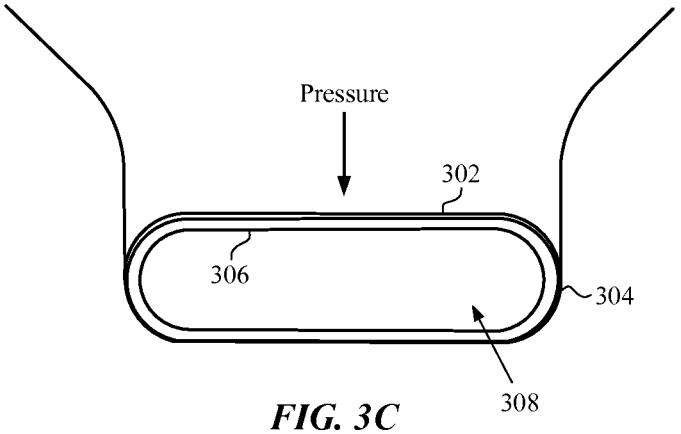

FIGS. 3A-3C show section views of a flat tube being formed using a process in accordance with some embodiments. At FIG. 3A, cylindrical tube 212 is positioned within die assembly 300, which includes first die 302 and second die 304. At FIG. 3B, first die 302 and second die 304 are brought together by applying pressure on first die 302 and/or second die 304. The pressure can be applied using any suitable means, including by way of a hydraulic, mechanical and/or pneumatic pressure system. At FIG. 3C, application of pressure is continued until cylindrical tube 212 conforms to a shape of the die assembly 300. That is, cylindrical tube 212 conforms to the shape of internal surfaces of first die 302 and second die 304. In particular, cylindrical tube 212 takes on a shape corresponding to a flat tube 306. Flat tube 306 retains hollow 308, in which a fluid can be passed in a subsequent hydroforming process.

Figure 4A:
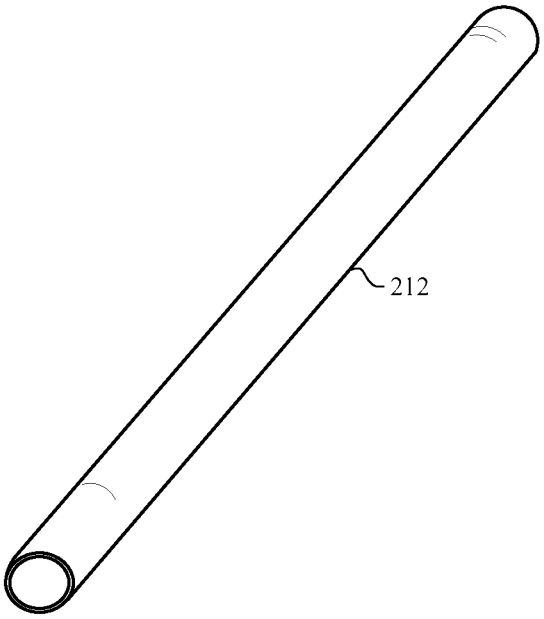
FIGS. 4A-4C show perspective views of a flat tube section formed from the flat tube described with respect to FIGS. 3A-3C.
Figure 4B:
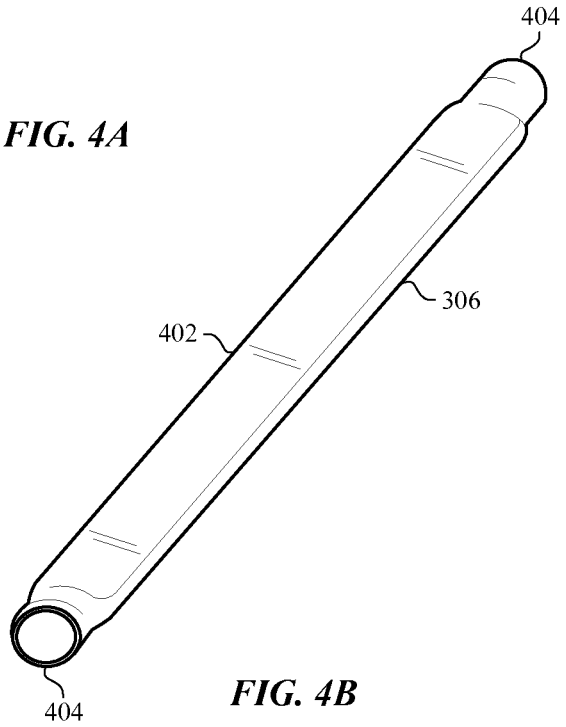
Figure 4C:
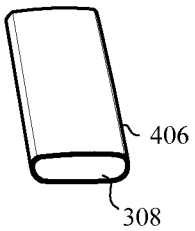

FIGS. 4A-4C show perspective views of flat tube 306 formed using the die assembly described above with respect to FIGS. 3A-3C, in accordance with some embodiments. FIG. 3A shows cylindrical tube 212 prior to a flattening process and FIG. 3B shows flat tube 306 formed after the flattening process. As shown, in some embodiments the flattening process flattens a central portion 402 of flat tube 306 while leaving sacrificial ends 404 unflattened. Sacrificial ends 404 may not be flat due to being positioned outside of the die assembly 300 during the flattening process. Sacrificial ends 404 can be cut off subsequent to the flattening process leaving flat tube 306 with a continuously flat shape. In other embodiments, all of flat tube 306 is positioned within die assembly 300 during a flattening process such that central portion 402 and ends 404 are both flattened.

In some embodiments, flat tube 306 is then cut into smaller flat tube sections 406. FIG. 4C shows a perspective view of a flat tube section 406 cut from flat tube 306. Flat tube section 406 retains hollow 308, in which fluid will be passed during a subsequent hydroforming process. Flat tube 306 can be cut to remove sacrificial ends 404 and into flat tube sections 406 using any suitable cutting process, including the use of a laser cutter, die cutter, mechanical saw, or a combination thereof.

Figure 5A:
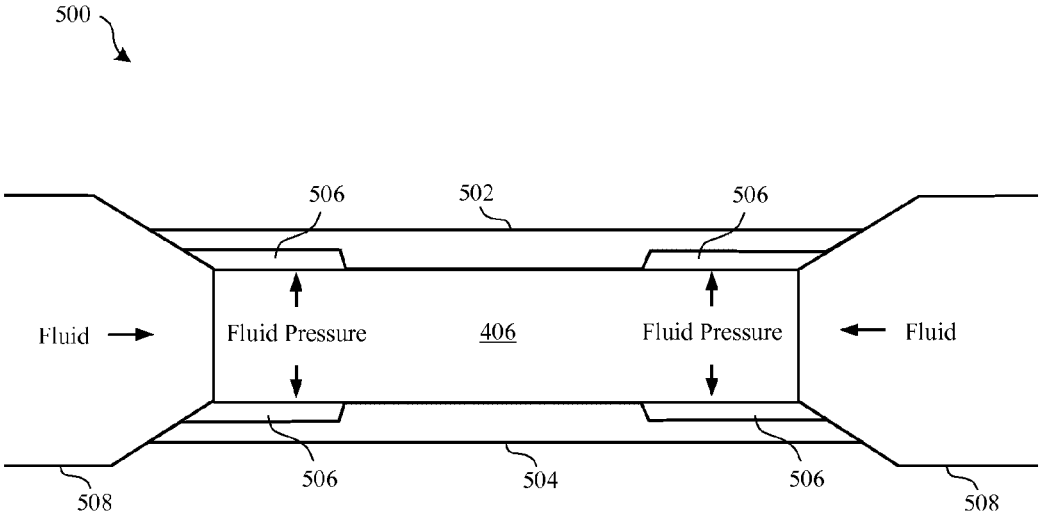
FIGS. 5A-5D show side section views of a metal shell formed using a hydroforming system from the flat tube section described with respect to FIGS. 4A-4C.

The flat tube 306 or flat tube section 406 can now be shaped using a hydroforming process. FIGS. 5A-5D show side section views of a metal shell formed using a hydroforming system 500 in accordance with some embodiments. At FIG. 5A, flat tube section 406 is positioned within a die assembly that includes first die 502 and second die 504. As shown, spaces 506 exist between flat tube section 406 and each of first die 502 and second die 504. After flat tube section 406 is positioned, fluid supplied by one or more conduits 508 is passed through opening 408 of flat tube section 406 at sufficient pressure to apply a fluid pressure to internal portions of flat tube section 406 proximate spaces 506. This causes the walls of flat tube section 406 to expand and fill spaces 506, thereby conforming to the geometry of first die 502 and second die 504. Note that first die 502 and second die 504 can have any suitable shape and is not limited to the shape as shown in FIG. 5A. For example, first die 502 and second die 504 can have shapes that expand only one end of flat tube section 406, or that expand the mid-section instead of the ends of flat tube section 406.

The fluid can be any suitable type of fluid, including an aqueous fluid. In some embodiments, the fluid includes a lubricant such as a surfactant to facilitate the hydroforming process. The fluid can be heated, at room temperature or even cooled. The fluid can be supplied at one or both ends of flat tube section 406 and can be pressurized using any suitable mechanism, including any of a number of suitable hydraulic pump systems. The amount of pressure will depend on factors such as the material of flat tube section 406 and thickness of the walls of flat tube section 406.

Figure 5B:
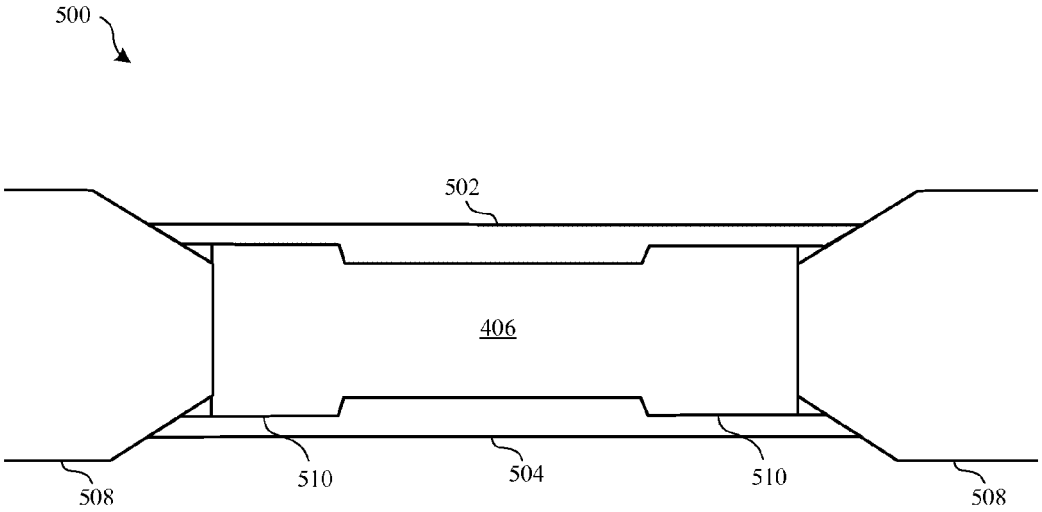
Figure 5C:
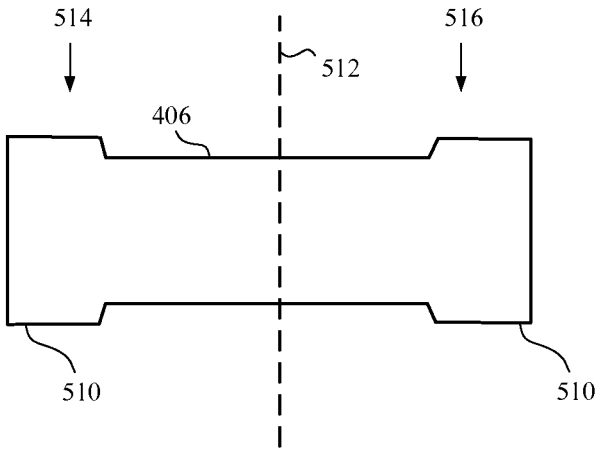

At FIG. 5B, end portions 510 of flat tube section 406 have been expanded to sufficiently conform to the internal surfaces of first die 502 and second die 504 and the pressurized fluid is removed. At FIG. 5C, flat tube section 406 is removed from hydroforming system 500. As shown, end portions 510 are expanded or flared. In some embodiments, flat tube section 406 is cut along plane or line 512, which can correspond to a centerline of flat tube section 406. The cutting can be performed using any suitable method, including the use of a laser cutter, die cutter, mechanical saw, or a combination thereof. Cutting along plane or line 512 results in two parts 514 and 516. In some cases, parts 514 and 516 are substantially identical. This can be beneficial in manufacturing processes where multiple identical parts are manufactured together.

Figure 5D:
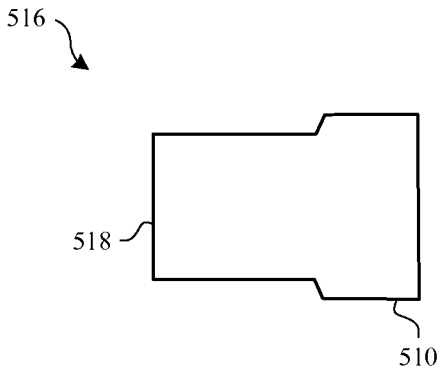

FIG. 5D shows part 516, which can correspond to metal shell that can serve as a portion of a housing for a connector, such as a USB connector. Metal shell 516 can include an expanded or flared portion 510, which can be configured to accept a molded portion of the housing for the connector. Metal shell 516 can also include tip 518, which can correspond to a portion of the connector that is mated with a corresponding connector. In some embodiments, tip 518 is further shaped to facilitate the mating process of the connector. For example, the edge of tip can be sharp. Thus in some case, the edge tip can be bent or tapered to smooth the edge.

Figure 6A:
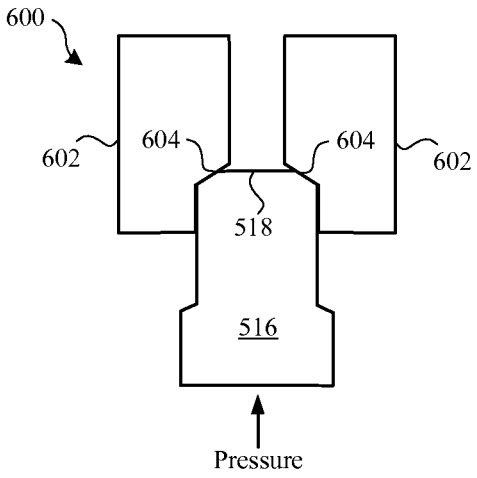
FIGS. 6A-6E show side section views of a shaped metal shell formed from the metal shell described with respect to FIGS. 5A-5D.
Figure 6B:
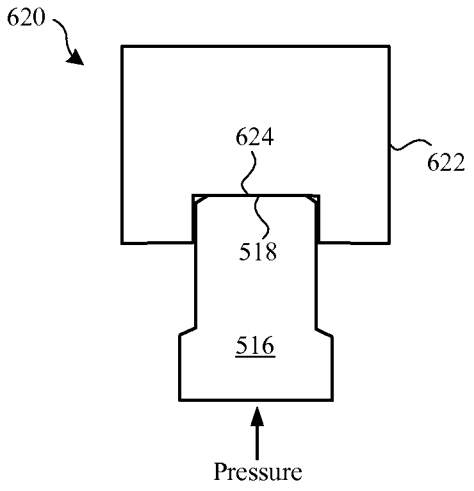
Figure 6C:
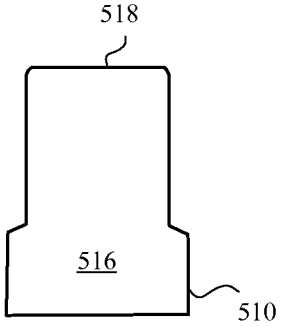

FIGS. 6A-6C show side section views of metal shell 516 shaped using a punching process in accordance with some embodiments. At 6A, metal shell is placed within a first punch system 600, which includes die portions 602. Note that in other embodiments, die portions 602 are embodied as a single die. Punch system 600 has an opening configured to accept metal shell 516 such that tip 518 contacts angled surfaces 604 of die portions 602. Angled surface 604 are configured to bend the edge of tip 518 at an angle corresponding to angled surfaces 604. In some embodiments, angles surfaces 604 are at 45 degree angles with respect to the edge of tip 518. In this way, when pressure is applied to metal shell 516, tip 518 is bent and tapered inward to form a first tapered shape. After tip 518 is sufficiently bent, metal shell 516 is removed from punch system 600.

At FIG. 6B, metal shell 516 is positioned within an opening of punch system 620. Punch system 620 includes die 622, which includes surface 624. Note that in other embodiments, die 622 is embodied as two or more dies. Surfaces 624 are designed to bend tip 518 further inward. In some embodiments, surface 624 is angled at a 90 degree angle (perpendicular) with respect to the edge of tip 518. When pressure is applied to metal shell 516, tip is bent and tapered further inward to form a second tapered shape. After tip 518 is sufficiently bent, metal shell 516 is removed from punch system 620.

Figure 6D:
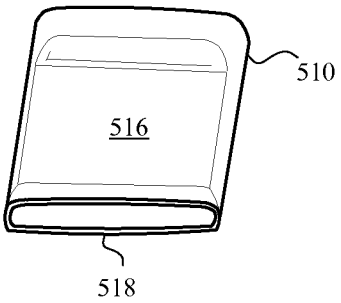

FIGS. 6C and 6D show side section and perspective views, respectively, of metal shell 516 after the bending processes described above with respect to FIGS. 6A and 6B. As described above, expanded end portion 510 can be configured to accept a molded portion of a housing for a connector and tip can correspond to a tapered insertion end of the connector. As shown, metal shell 516 is substantially seamless in that there are no joints, such as metal shell 100 described above with reference to FIGS. 1A-1E. In this way, exterior surfaces of metal shell 516 are aesthetically pleasing for consumers of connectors and electronic devices. In addition, since the manufacturing process avoids the use of joints, there are no operations associated with aligning the joints. This means there is less risk of scratching or galling of the surfaces of metal shell 516 during the manufacturing process. This will reduce the number of defective parts during manufacture of product lines of metal shell 516. If the edge of tip 518 is tapered this reduces the sharpness of tip and facilitates the connection or mating function of the connector, as well as improves the look and feel of metal shell 516.

Figure 6E:
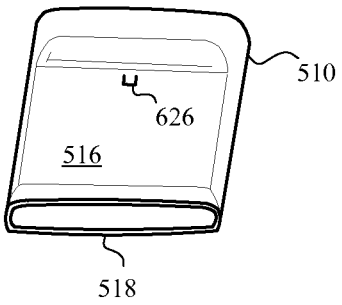

FIG. 6E shows another embodiment of metal shell 516, which includes feature 626 at or near expanded end portion 510. Feature 626 can correspond to a slit, opening, indentation or protrusion that is configured to engage with a subsequently molded on portion of the housing of the connector. For example, molded material can deposit within or around feature 626 to provide an additional surface for the molded material to engage with and keep the molded portion secured to metal shell 516.

FIG. 7 shows flowchart 700 indicating a high-level process for forming a metal shell as part of a housing for a connector in accordance with described embodiments. At 702, a flat tube is formed by flattening a cylindrical tube. The cylindrical tube can be substantially free of visible seams or joints and can be manufactured using the methods described above. The flat tube includes a first end portion, a second end portion and an internal hollow portion. At 704, a pressurized fluid is injected within the internal hollow portion to expand a portion of the flat tube. This can be done while the flat tube is positioned within a die such that the portion of the flat tube is expanded to conform with a geometry of the die. In some embodiments, the pressurized fluid expands one or both of the first end portion and the second end portion. The metal shell can correspond to a portion of a housing of the connector.

FIG. 8 shows flowchart 800 indicating a manufacturing process for forming a metal shell as part of a housing for a connector in accordance with described embodiments. At 802, a seamless cylindrical tube is formed. The seamless cylindrical tube can be formed using any suitable process. For example, one or more coiling, rolling, bending, stamping and/or pressing techniques performed on a blank metal sheet can be used. In some embodiments, a laser welding process is used to weld the ends of the blank together in a seamless fashion. At 804, flattening the cylindrical tube forms a flat tube. Controlled flattening can be achieved by pressing the cylindrical tube within a die assembly that has flat surfaces. In some embodiments, the die assembly includes two dies that have substantially flat surfaces.

At 806, a flat tube section is cut from the flat tube. Any of a number of cuts can be used to form any suitable number of flat tube sections, depending on the length of the flat tube and a desired length of each flat tube section. In some embodiments, the sacrificial ends of the flat tube are cut away from the flat tube sections. Any suitable cutting method can be used, including laser cutting, die cutting and/or mechanical saw cuttings techniques. At 808, pressurized fluid is injected into the flat tube section such that the ends of the flat tube section are expanded. This can be done with in a die having a predetermined shape such that the flat tube section takes on a shape in accordance with the shape of the die. In some embodiments, the ends of the flat tube are expanded or flared while a central portion of the flat tube section remains substantially unexpanded.

At 810, a metal shell is cut from the flat tube section. In some embodiments, the flat tube is cut along a centerline or plane such that two symmetric metal shells are formed. The cutting can be performed using a laser cutter, die cutter, mechanical saw. The metal shell includes an expanded end, configured to accept a molded portion of the housing of the connector, and a tip, configured to attach to a corresponding connector. At 812, the tip is optionally tapered to improve mating of the connector as well as improve the appearance of the metal shell. At FIG. 814, an engagement feature is optionally formed on an exterior surface of the metal shell that is configured to engage with a subsequently molded on molded portion of the connector. The engagement feature can be in the form of a slit, opening, indentation, or protrusion.

After 814, the metal shell can be further processes and fabricated into a connector for an electronic device. For example, a molded portion of the connector can be molded onto the metal shell. Note that not all elements 802-814 of flowchart 800 are necessarily performed in every embodiment. In addition, the sequence of elements 802-814 may be changed, if suitable, as desired in a particular manufacturing process.

The manufacturing methods described herein can be performed with the aid of one or more devices for controlling computer numerical control (CNC) machines. For example, CNC machines can be used to perform any of a number of cutting, bending, hydroforming, stamping, punching process described above and can also be used to control robotic arms for positioning parts during the manufacturing process. FIG. 9 is a block diagram of electronic device 900 describing components suitable for controlling operations of a CNC machining operation in accordance with the described embodiments. Electronic device 900 illustrates components and circuitry of a representative computing device.

Electronic device 900 includes a processor 902 that pertains to a microprocessor or controller for controlling the overall operation of electronic device 900. Electronic device 900 contains instruction data pertaining to operating instructions in a file system 904 and a cache 906. The file system 904 is, typically, a storage disk or a plurality of disks. The file system 904 typically provides high capacity storage capability for the electronic device 900. However, since the access time to the file system 904 is relatively slow, the electronic device 900 can also include a cache 906. The cache 906 is, for example, Random-Access Memory (RAM) provided by semiconductor memory. The relative access time to the cache 906 is substantially shorter than for the file system 904. However, the cache 906 does not have the large storage capacity of the file system 904. Further, the file system 904, when active, consumes more power than does the cache 906. The power consumption is often a concern when the electronic device 900 is a portable device that is powered by a battery 924. The electronic device 900 can also include a RAM 920 and a Read-Only Memory (ROM) 922. The ROM 922 can store programs, utilities or processes to be executed in a non-volatile manner. The RAM 920 provides volatile data storage, such as for cache 906.

The electronic device 900 also includes a user input device 908 that allows a user of the electronic device 900 to interact with the electronic device 900. For example, the user input device 908 can take a variety of forms, such as a button, keypad, dial, touch screen, audio input interface, visual/image capture input interface, input in the form of sensor data, etc. Still further, the electronic device 900 includes a display 910 (screen display) that can be controlled by the processor 902 to display information to the user. A data bus 916 can facilitate data transfer between at least the file system 904, the cache 906, the processor 902, and a CODEC 913. The CODEC 913 can be used to decode and play a plurality of media items from file system 904 that can correspond to certain activities taking place during a particular manufacturing process. The processor 902, upon a certain operating event or events occurring, supplies the media data (e.g., audio file) for the particular media item to a coder/decoder (CODEC) 913. The CODEC 913 then produces analog output signals for a speaker 914. The speaker 914 can be a speaker internal to the electronic device 900 or external to the electronic device 900. For example, headphones or earphones that connect to the electronic device 900 would be considered an external speaker.

The electronic device 900 also includes a network/bus interface 911 that couples to a data link 912. The data link 912 allows the electronic device 900 to couple to a host computer or to accessory devices. The data link 912 can be provided over a wired connection or a wireless connection. In the case of a wireless connection, the network/bus interface 911 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 926 can take the form of circuitry for detecting any number of stimuli. For example, sensor 926 can include any number of sensors or measurement tools for monitoring various operating conditions during a machining operation. For example, sensor 926 can include a number of different sensors 926 such as for example a temperature sensor, an audio sensor, a light sensor such as a photometer, a depth measurement device such as a laser interferometer and so on. In some embodiments sensor 926 can take the form of a spring-based measurement apparatus along the lines of a probe to determine a position of a workpiece during a machining operation.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A method of forming a connector for an electronic device, the method comprising:

forming a flat tube by flattening a cylindrical tube, the flat tube having a first end portion, a second end portion and an internal hollow portion;

arranging the flat tube in a die;

forming a metal shell by injecting pressurized fluid within the internal hollow portion until the first end portion and the second end portion expand to conform with a geometry of the die; and cutting the metal shell such that a first and a second metal shell are formed, wherein one of the first or the second metal shells correspond to a portion of a housing of the connector.

2. The method of claim 1, further comprising:

forming one or more features within the expanded portion of the first or the second metal shells, the one or more features configured to engage with the molded portion of the housing.

3. The method of claim 1, wherein the metal shell is substantially free of a visible joint or seam.

4. The method of claim 1, further comprising:

prior to forming the flat tube, forming the cylindrical tube by:

rolling a metal sheet such that a first end of the metal sheet is proximate a second end of the metal sheet, and laser welding the first end to the second end such that an interface between the first end and the second end is visually undetectable.

5. The method of claim 1, wherein each of the first and the second metal shells includes a tip located opposite of the expanded end, the method further comprising:

shaping the tip such that the tip has a tapered edge.

6. The method of claim 5, wherein shaping the tip comprises:

arranging one of the first or the second metal shells within a first die;

pressing the metal shell against the first die such that the tip conforms to a first tapered shape;

arranging the metal shell within a second die; and pressing the metal shell against the second die such that the tip conforms to a second tapered shape different than the first tapered shape.

7. The method of claim 1, wherein forming the flat tube comprises:

arranging the cylindrical tube within a die assembly, the die assembly including an upper die and a lower die; and pressing the upper die and lower die together such that the cylindrical tube conforms to a shape of the die assembly.

8. A method of forming a connector for an electronic device, the method comprising:

forming a flat tube by flattening a cylindrical tube;

cutting a flat tube section from the flat tube, the flat tube section including opposing end portions;

arranging the flat tube section in a die;

injecting pressurized fluid within the flat tube section until each of the opposing end portions expands to conform with a geometry of the die; and cutting two metal shells from the flat tube section such that each of the two metal shells includes an expanded end portion and wherein one of the two metal shells forms a portion of a housing of the connector.

9. The method of claim 8, wherein the expanded end portion of one of the two metal shells is configured to accept a molded portion of the housing.

10. The method of claim 9, further comprising:

forming one or more features within the expanded end portion of one of the two metal shells, the one or more features configured to engage with the molded portion.

11. The method of claim 8, further comprising:

prior to forming the flat tube, forming the cylindrical tube by:

rolling a metal sheet such that a first end of the metal sheet is proximate a second end of the metal sheet, and laser welding the first end to the second end such that an interface between the first end and the second end is visually undetectable.

12. The method of claim 8, wherein the connector is a universal serial bus (USB) connector.

13. The method of claim 8, wherein each of the two metal shells includes a tip opposite the expanded end portion, the method further comprising:

shaping the tip such that the tip has a tapered edge.

14. The method of claim 13, wherein shaping the tip comprises:

arranging one of the two metal shells within a first die;

pressing the metal shell against the first die such that the tip conforms to a first tapered shape;

arranging the metal shell within a second die; and pressing the metal shell against the second die such that the tip conforms to a second tapered shape different than the first tapered shape.

15. The method of claim 8, wherein forming the flat tube comprises:

arranging the cylindrical tube within a die assembly, the die assembly including an upper die and a lower die; and pressing the upper die and lower die together such that the cylindrical tube conforms to a shape of the die assembly.

16. The method of claim 8, wherein cutting the two metal shells from the flat tube section comprises cutting along a centerline of the flat tube section.

17. The method of claim 8, wherein cutting the two metal shells from the flat tube section comprises one or more of a laser cutting and die cutting process.

18. A method of manufacturing a connector for an electronic device, the method comprising:

rolling a metal sheet such that a first end of the metal sheet is proximate a second end of the metal sheet;

forming a cylindrical tube by laser welding the first end to the second end such that an interface between the first end and the second end is visually undetectable;

forming a flat tube by flattening a cylindrical tube;

cutting a flat tube section from the flat tube, the flat tube section including opposing end portions;

arranging the flat tube section in a die;

injecting pressurized fluid within the flat tube section until each of the opposing end portions expands to conform with a geometry of the die; and cutting two metal shells from the flat tube section such that each of the two metal shells includes an expanded end portion and wherein one of the two metal shells forms a portion of a housing of the connector.

19. The method of claim 18, wherein each of the two metal shells includes a tip opposite the expanded end portion, the method further comprising:

shaping the tip such that the tip has a tapered edge.

20. The method of claim 19, wherein shaping the tip comprises:

positioning one of the two metal shells within a first die;

pressing the metal shell against the first die such that the tip conforms to a first tapered shape;

positioning the metal shell within a second die; and pressing the metal shell against the second die such that the tip conforms to a second tapered shape different than the first tapered shape.

* * * * *